US006443715B1

(12) United States Patent
Mayleben et al.

(10) Patent No.: US 6,443,715 B1
(45) Date of Patent: Sep. 3, 2002

(54) PUMP IMPELLER

(75) Inventors: Philip A. Mayleben, Edgewood, KY (US); Scott R. Graham, West Chester, OH (US); Buford A. Cooper, Sunman, IN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 0 days.

(21) Appl. No.: 09/717,976

(22) Filed: Nov. 20, 2000

Related U.S. Application Data

(60) Provisional application No. 60/166,567, filed on Nov. 19, 1999.

(51) Int. Cl.[7] ..... F04B 17/00; F04B 49/04; F03G 7/00; F01D 1/02

(52) U.S. Cl. ..... 417/423.1; 417/356; 417/423.9; 417/40; 416/3; 416/186 R; 415/206

(58) Field of Search ..... 417/423.1, 356, 417/423.9, 40; 416/3, 186 R, 189, 192; 415/10, 204, 206

(56) References Cited

U.S. PATENT DOCUMENTS

| | | | | |
|---|---|---|---|---|
| 4,050,396 A | * | 9/1977 | Ridgeway | 417/40 |
| 4,428,717 A | * | 1/1984 | Catterfeld | 416/186 R |
| 4,981,417 A | * | 1/1991 | Arbeus | 416/186 R |
| 5,573,369 A | * | 11/1996 | Du | 415/206 |
| 5,816,784 A | * | 10/1998 | Postuchow et al. | 417/423.11 |
| 6,210,116 B1 | * | 4/2001 | Kuczaj et al. | 416/186 R |

* cited by examiner

*Primary Examiner*—Charles G. Freay
*Assistant Examiner*—Michael K. Gray
(74) *Attorney, Agent, or Firm*—Jones, Day, Reavis & Pogue

(57) ABSTRACT

A pump impeller having a central hub and circumferentially-spaced bottom vanes extending in a direction outwardly of the hub. An annular shroud surrounds the hub in outwardly-spaced relationship thereto and provides an impeller liquid inlet passage around the hub leading to the vanes. A permanent magnet motor rotor is mounted on the annular shroud. The rotor is used in a sump pump having an upper cylindrical filter that encloses a float switch for operating the pump motor.

16 Claims, 12 Drawing Sheets

FIG. 19
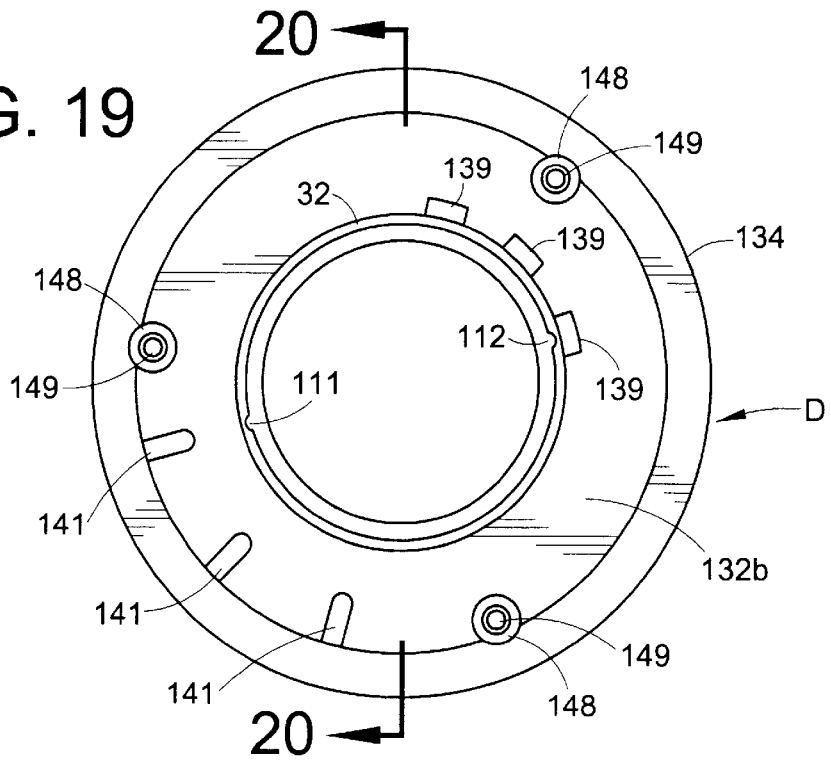
FIG. 20
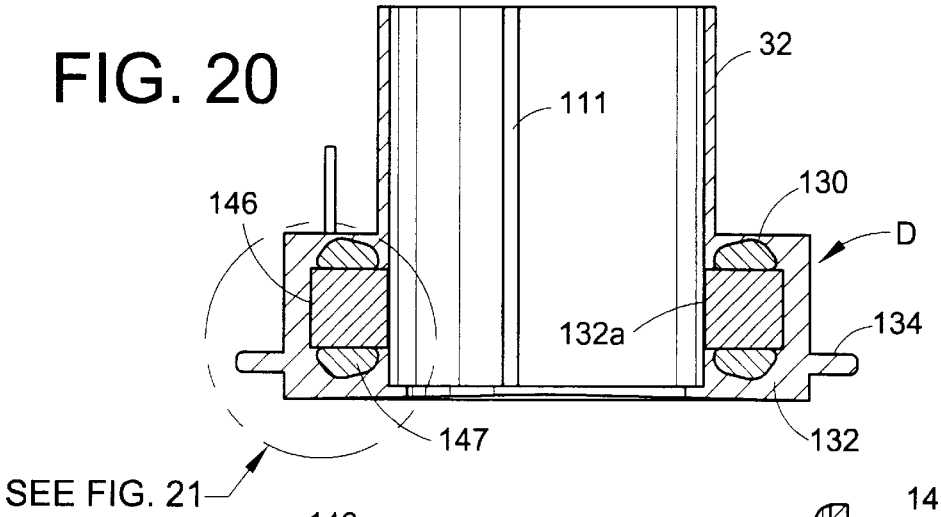
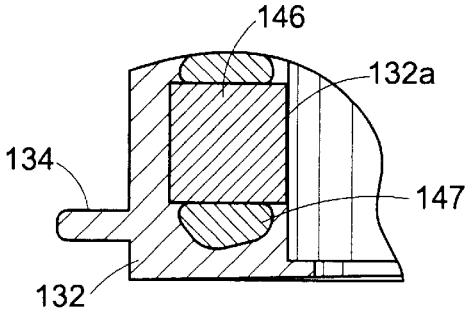
FIG. 21
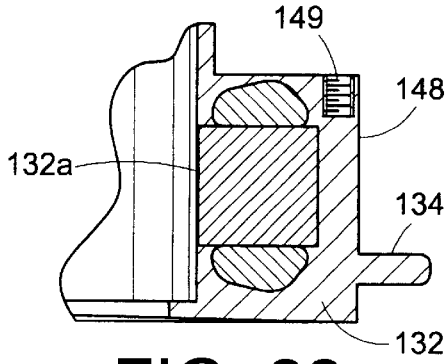
FIG. 22

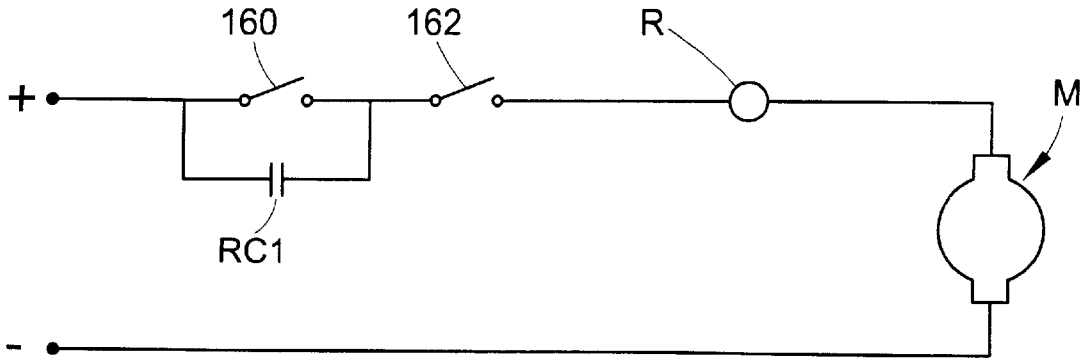
FIG. 30
FIG. 31
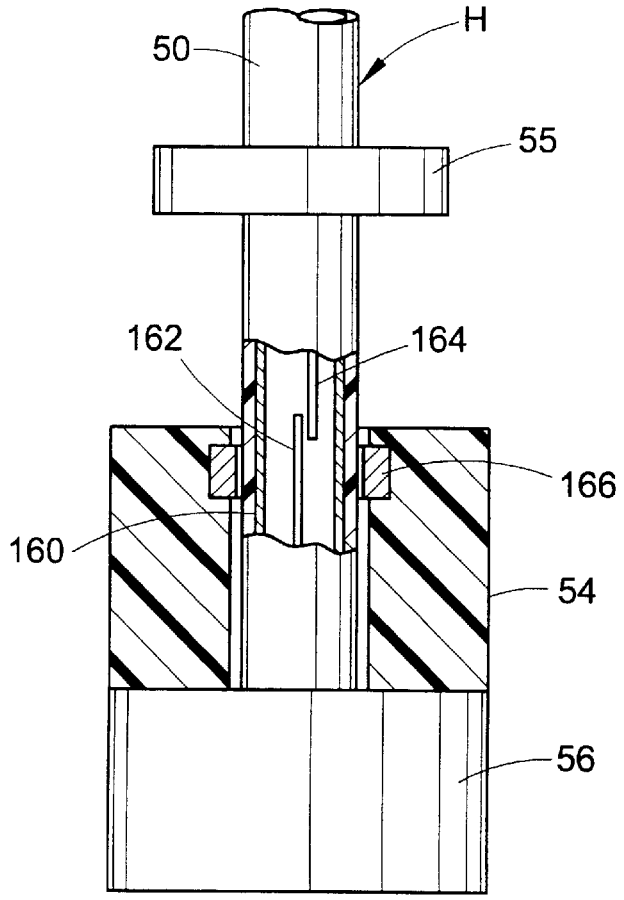

PUMP IMPELLER

This application claims subject matter disclosed in U.S. Provisional Application Serial No. 60/166.567 filed Nov. 19, 1999, the benefit of the filing date of which is hereby claimed.

BACKGROUND OF THE INVENTION

This application relates to the art of pumps and, more particularly, to pump impellers and inlet filter assemblies. The invention is particularly applicable for use with sump pumps and will be described with specific reference thereto. However, it will be appreciated that many features of the invention have broader aspects and can be used in other types of pumps.

Many sump pumps require seals for minimizing backflow of liquid from the discharge side of the pump back toward the inlet which reduces pump efficiency. It would be desirable to have an essentially sealless sump pump that nevertheless minimizes backflow of liquid from the impeller chamber toward the inlet.

Many sump pumps have filters located very low on the pump housing within the sump and are very difficult to clean without removing the entire pump from the sump. It would be desirable to provide a sump pump with a top mounted filter assembly that is easily accessible for cleaning.

Float operated switches on sump pumps commonly are exposed to damage or may malfunction due to debris. It would be desirable to position a float switch in a protected location where it is not subject to damage or to fouling by debris.

SUMMARY OF THE INVENTION

In accordance with the present application, a pump impeller has an annular liquid inlet surrounding the impeller rotational axis. Incoming liquid flows axially through the impeller in an annular stream to the impeller vanes for discharge from a pinched vaneless diffuser and a volute in which the impeller rotates.

In a preferred arrangement, a permanent magnet motor rotor ring is attached to the impeller in surrounding relationship to the annular liquid inlet so that incoming liquid flows through the center of the magnet ring.

The impeller includes a central hub on which the impeller is rotatably mounted. An annular shroud surrounds the hub in outwardly-spaced relationship thereto so that the annular liquid inlet passage is defined between the hub and the annular shroud.

A plurality of circumferentially-spaced vanes extend in a direction outwardly of the hub adjacent the bottom thereof. The hub includes a hub bottom shroud that extends outwardly from the hub beneath the vanes, and the annular shroud extends upwardly above the vanes. A steel ring is molded onto the exterior of the impeller annular shroud, and the annular permanent magnet motor rotor ring is attached to the steel ring.

In accordance with another aspect of the application, a cylindrical filter assembly is provided on the top portion of the pump. A float switch assembly for operating the pump motor is mounted inside of the filter assembly to protect same from damage and to prevent malfunctioning thereof by debris.

The filter assembly includes a perforate cylindrical sheet metal member surrounded by a pleated screen. Top and bottom rings receive top and bottom end portions of the sheet metal member and screen, and the assembly is attached to the pump base by elongated bolts.

It is a principal object of the invention to provide an improved pump impeller.

It is another object of the invention to provide a pump impeller having a permanent magnet motor rotor attached thereto.

It is also an object of the invention to provide an improved filter assembly for a sump pump.

It is an additional object of the invention to provide an improved arrangement for protecting a float switch assembly against damage or fouling by debris.

BRIEF DESCRIPTION OF THE DRAWING

FIG. 19 is a top plan view thereof;

FIG. 20 is a cross-sectional elevational view thereof;

FIG. 21 is an enlarged detail of the circled detail in FIG. 20;

FIG. 22 is an enlarged detail showing an attachment post on the stator assembly for a pc board;

FIG. 30 is a diagrammatic showing of how a pair of float switches can be used to operate a pump motor; and FIG. 31 is a cross-sectional elevational view of a reed float switch.

DESCRIPTION OF A PREFERRED EMBODIMENT

Figure 1:
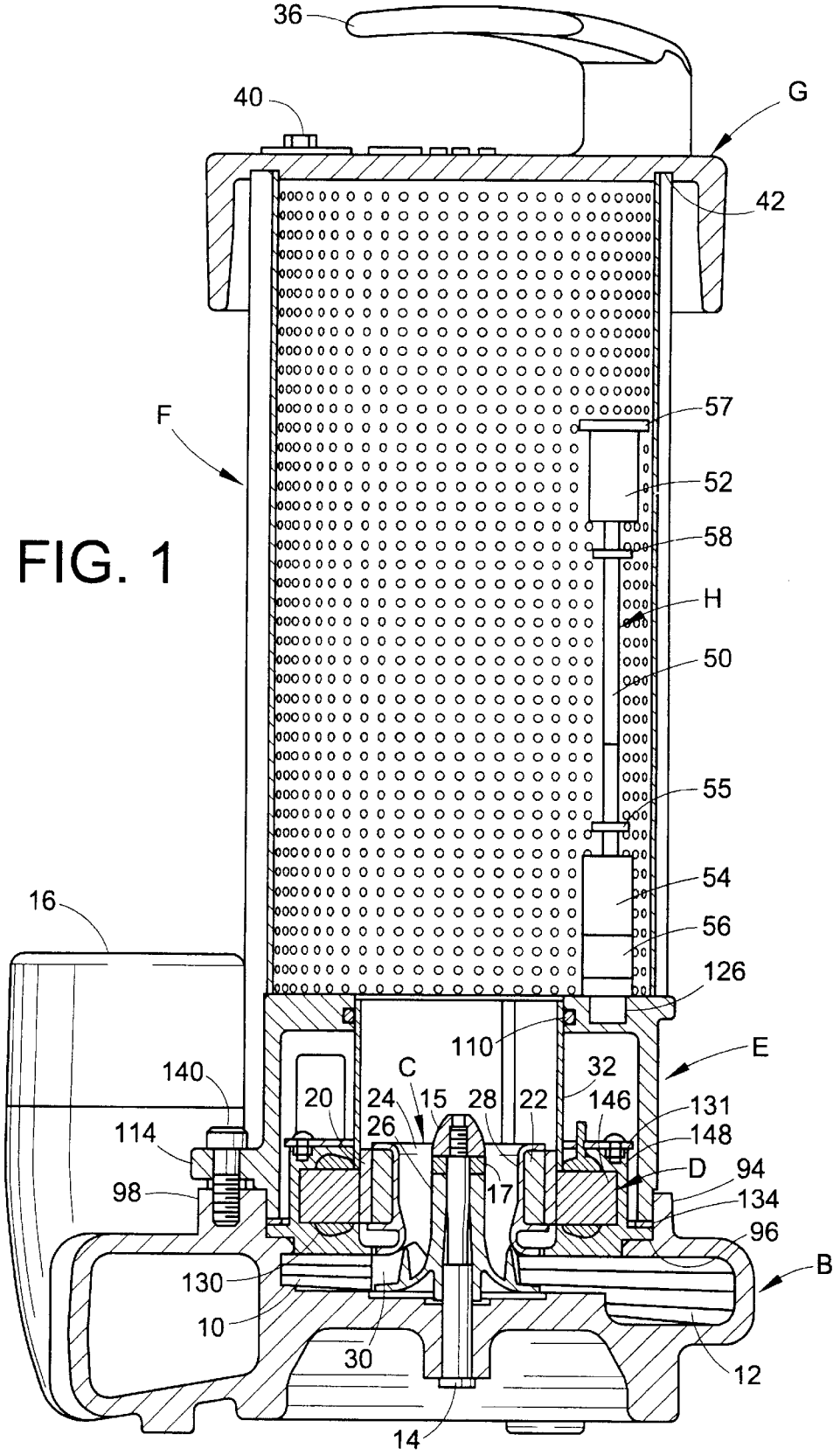
FIG. 1 is a cross-sectional elevational view of a sump pump having the improved features of the present application incorporated therein.

Referring now to the drawings, wherein the showings are for purposes of illustrating certain preferred embodiments of the invention only and not for purposes of limiting same, FIG. 1 shows a pump base B having a pinched vaneless diffuser 10 and a volute 12 therein. A vertical shaft 14 attached to base B has an impeller C rotatably mounted thereon. Impeller C is secured on shaft 14 by a cone nut 15 threaded onto the upper end portion of shaft 14, and a thrust bearing bushing 17 is interposed between the nut and the top end of the impeller hub. Impeller vanes located in diffuser 10 increase the static pressure and velocity of liquid entering the vanes by operation of centrifugal force as the impeller rotates. The liquid is discharged from diffuser 10 to volute 12 and then through base outlet 16 that is attached to an outlet pipe in a known manner.

A permanent magnet motor stator D is secured to base B in surrounding relationship to impeller C. A permanent magnet motor ring 20 is attached to a steel ring 22 on impeller C for cooperating with stator D to impart rotation to impeller C when the motor is energized.

An annular liquid inlet passage 24 surrounds impeller hub 26, and is located between hub 26 and an annular shroud 28 that is located in outwardly-spaced relationship to hub 26. Annular inlet passage 24 leads to the impeller vanes, only one of which is generally indicated at 30 in FIGS. 1 and 2.

Permanent magnet motor stator D is encapsulated in plastic material to define a stator housing having an integral cylindrical sleeve 32 extending upwardly therefrom through a suitable hole in a motor cover E which is attached to pump base B and also secures motor stator D thereto. Incoming water enters sleeve 32 and flows through annular impeller inlet passage 24 to impeller vanes 30 for discharge through outlet 16.

A cylindrical filter assembly F is attached to motor cover E for filtering liquid that flows to sleeve 32. A filter cover G having a handle 36 thereon overlies filter assembly F and is attached to motor cover E by a plurality of elongated bolts, only one of which is generally shown at 40 in FIG. 1. A plurality of the circumferentially-spaced bolts 40 extend through suitable holes in cover G along the outside of filter assembly F and thread into tapped holes in ears that extend outwardly from motor cover E. A downwardly opening circular channel 42 in the underside of filter cover G receives the top end portion of filter assembly F.

A float switch assembly H for operating the motor is attached to motor cover E within filter assembly F for protecting same against damage and against fouling by debris. Filter assembly H includes an elongated mast 50 having upper and lower floats 52, 54 slidable thereon for operating upper and lower float switches. Bottom float 54 moves between stops 55 and 56, while upper float 52 moves between upper and lower stops 57 and 58. Stop 58 on the upper end of mast 50 extends outwardly beyond float 52 into engagement with the interior surface of filter assembly F to stabilize filter assembly H and ensure that floats 52, 54 remain out of engagement with filter assembly F for reliable operation. The float switch assembly is illustrated in the sectional view of FIG. 1 in a circumferentially displaced position from its actual position for clarity of illustration and explanation.

Figure 2:
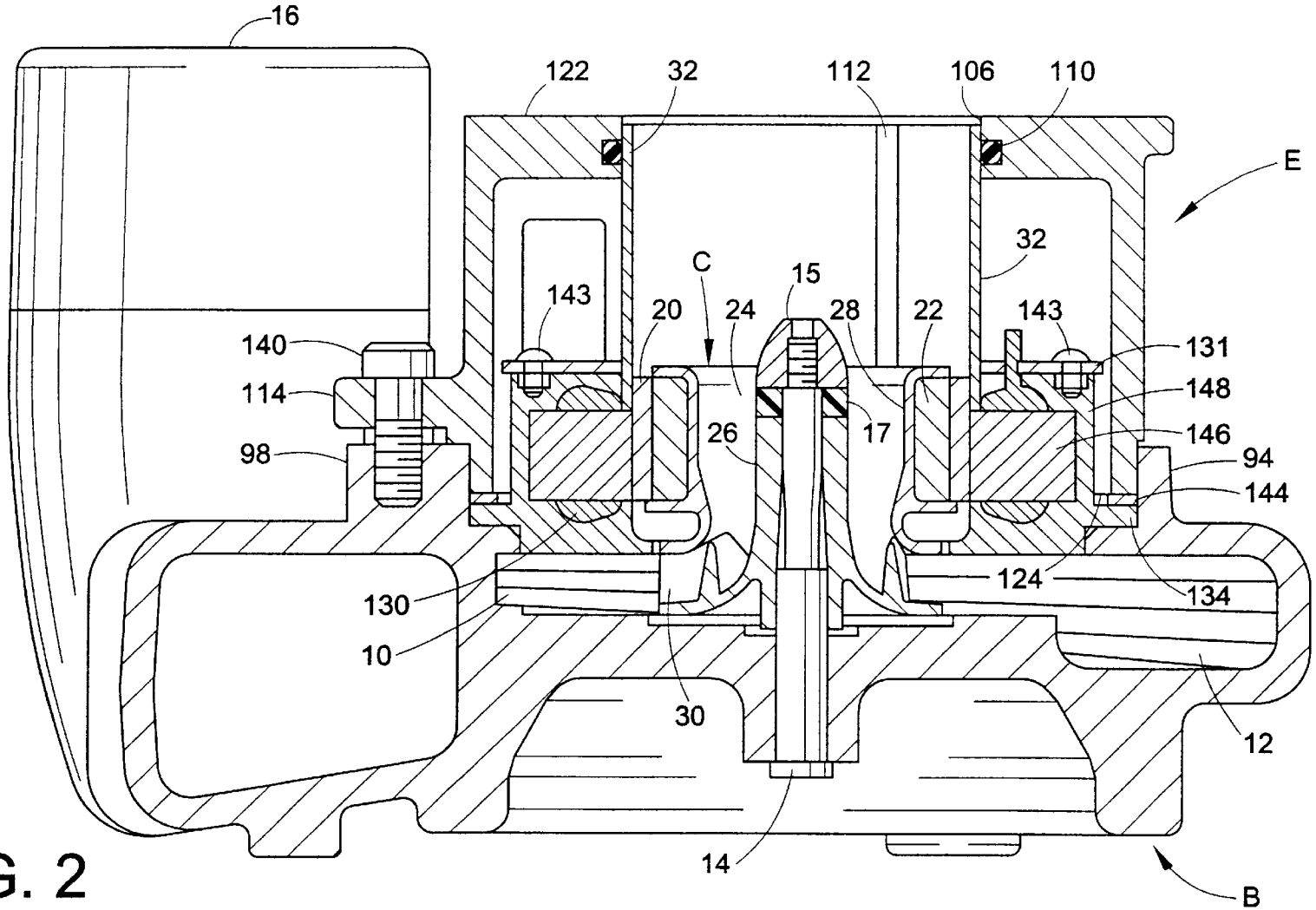
FIG. 2 is an enlarged cross-sectional elevational view of the motor, impeller and base of the pump assembly of FIG. 1.
Figure 3:
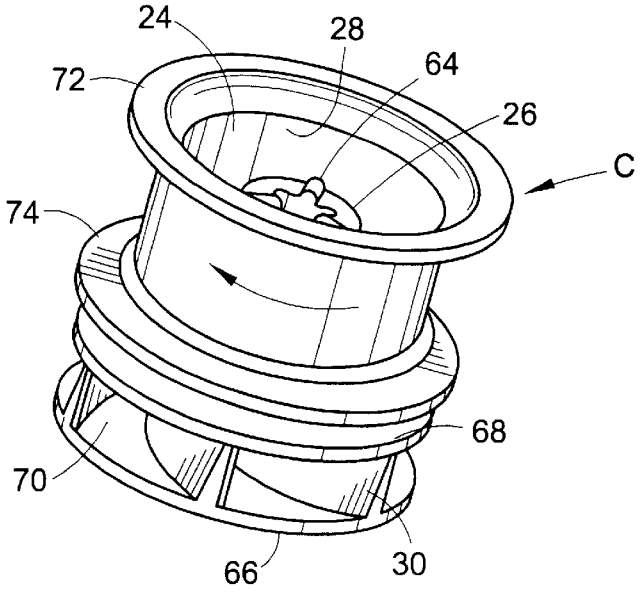
FIG. 3 is a perspective illustration of a pump impeller.
Figure 4:
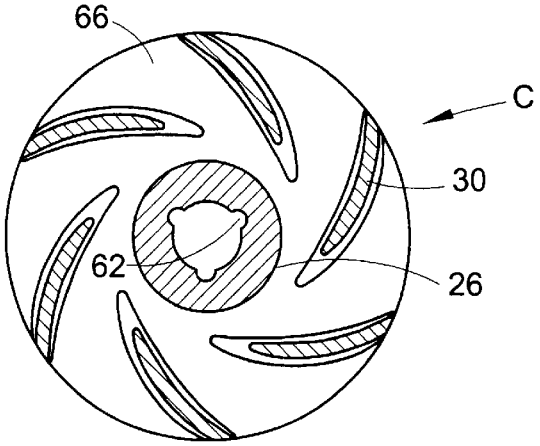
FIG. 4 is a cross-sectional elevational view of the pump impeller showing the impeller vanes.
Figure 5:
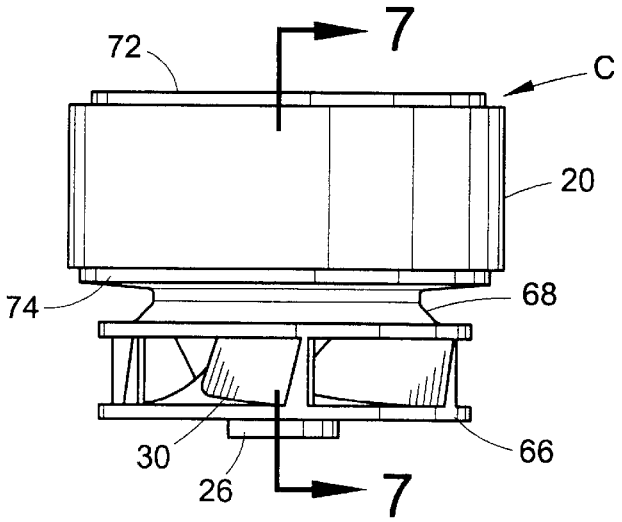
FIG. 5 is a side elevational view of the pump impeller having a permanent magnet motor rotor attached thereto.
Figure 6:
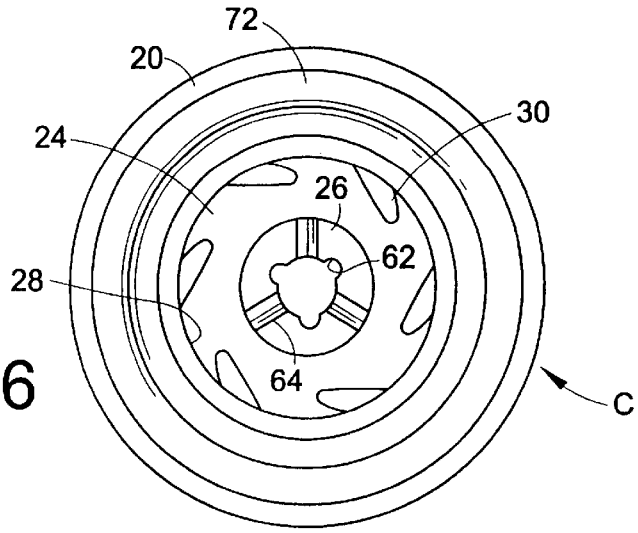
FIG. 6 is a top plan view thereof.
Figure 7:
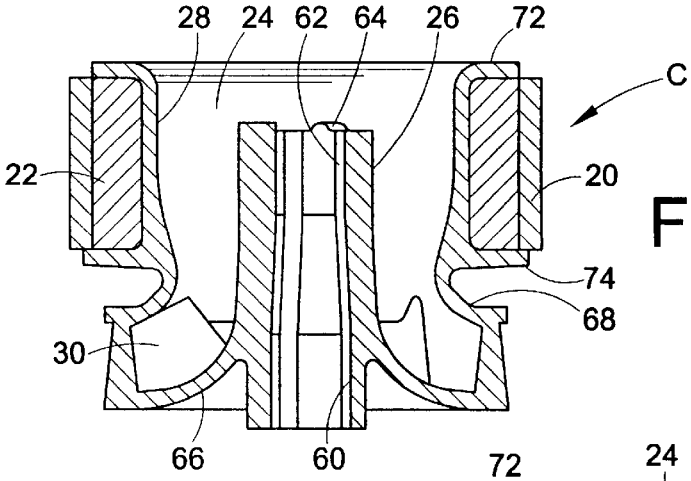
FIG. 7 is a cross-sectional elevational view taken generally on line 7—7 of FIG. 5.
Figure 8:
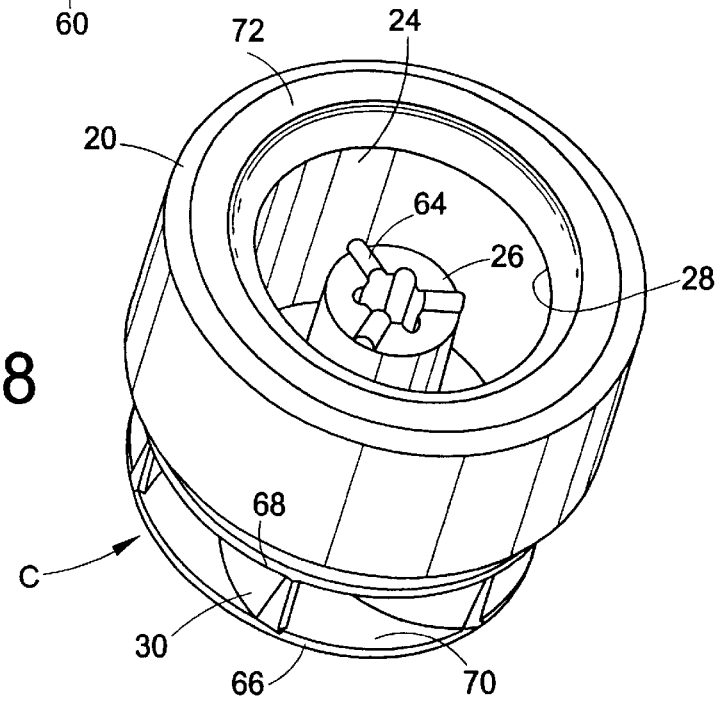
FIG. 8 is a perspective illustration thereof.

Referring now to FIGS. 3–8, impeller hub C has a central hole 60 therethrough for receiving shaft 14 of FIGS. 1 and 2 to provide rotation of impeller C on shaft 14. Impeller hole 60 has a plurality of circumferentially-spaced longitudinal grooves therein, only one of which is referenced by a numeral 62 in FIGS. 4, 6, 7 and 8, for lubrication flow and to allow flushing of debris. The top end of hub 26 has three circumferentially-spaced radially extending arcuate projections 64 thereon for reception in matching grooves in thrust bearing 17.

The bottom end portion of impeller hub 26 extends outwardly beneath vanes 30 to provide a hub bottom shroud 66. Impeller annular shroud 28 extends upwardly above impeller vanes 30, and includes an outwardly curved bottom portion 68 above vanes 30. Vanes 30 extend between hub bottom shroud 66 and bottom portion 68 of upper annular shroud 28 to provide a plurality of circumferentially-spaced impeller discharge outlets between the vanes, only one of such outlets being indicated by a numeral 70.

Impeller C preferably is molded of synthetic plastic material, and ring 22 of magnetic steel preferably is insert molded therewith between outwardly extending flanges 72, 74 that extend outwardly from impeller annular shroud 28. Permanent magnet motor ring 20 may be bonded to steel ring 22 with a suitable adhesive, such as epoxy.

Magnet ring 20 is radially magnetized with alternating north and south poles on the inner and outer peripheries thereof. Obviously, the polarity of the poles on the inner and outer peripheries is such that the poles of one polarity on the outer surface are radially aligned with poles of opposite polarity on the inner surface. For a four pole rotor, the magnet ring is radially magnetized to have four poles, each extending over 90° and alternating in polarity around the ring circumference. For an eight pole rotor, each pole extends over 45°. Magnetic flux exits the north poles on the outer periphery, and extends outwardly therefrom and then back toward the adjacent two south poles. Steel ring 22 provides a more efficient flux return path on the inner surface of the magnet ring and increases the strength of the magnet.

Figure 10:
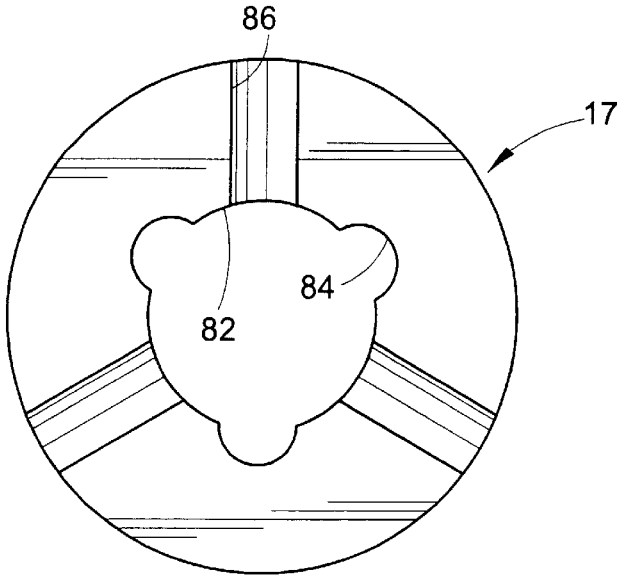
FIG. 10 is a top plan view thereof.
Figure 9:
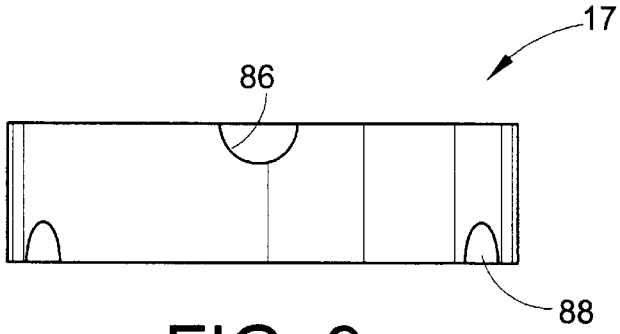
FIG. 9 is a side elevational view of a thrust bearing.
Figure 11:
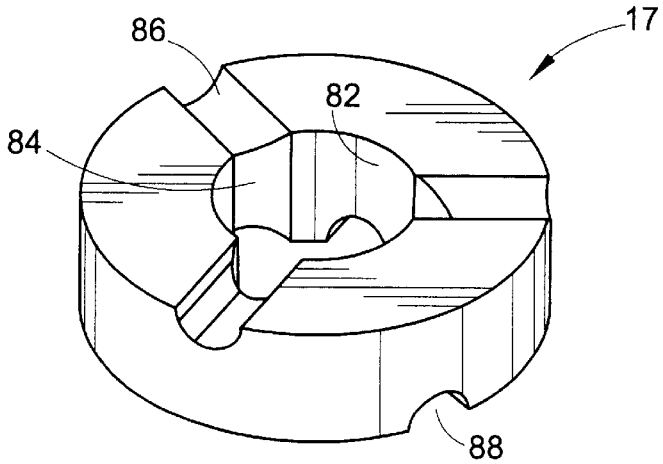
FIG. 11 is a perspective illustration thereof.

FIGS. 9–11 show generally cylindrical flat thrust bearing bushing 70 having a central hole 82 for closely receiving shaft 14. A plurality of longitudinal grooves 84 in the periphery of hole 82 allow flow of liquid therethrough for lubrication and flushing of debris. Three circumferentially-spaced radially extending arcuate grooves 86 are provided in one flat surface of bearing member 80 and corresponding grooves 88 are provided in the opposite flat surface rotatably displaced 60 degrees from grooves 86. Either grooves 86 or 88 are dimensioned, shaped and positioned for receiving projections 64 on the top end of impeller hub 26 so that bearing member 86 rotates with impeller C. The radial grooves in both the top and bottom flat surfaces of bearing member 80 permit installation thereof in either of inverted positions. The radial grooves that do not receive projections 64 on hub 26 allow flow of liquid radially between the bottom of nut 15 and the top surface of bearing bushing 17 for entering the vertical grooves in the inner peripheral surfaces of the bushing and the impeller hub for lubrication and for allowing flushing of any small particles.

Figure 12:
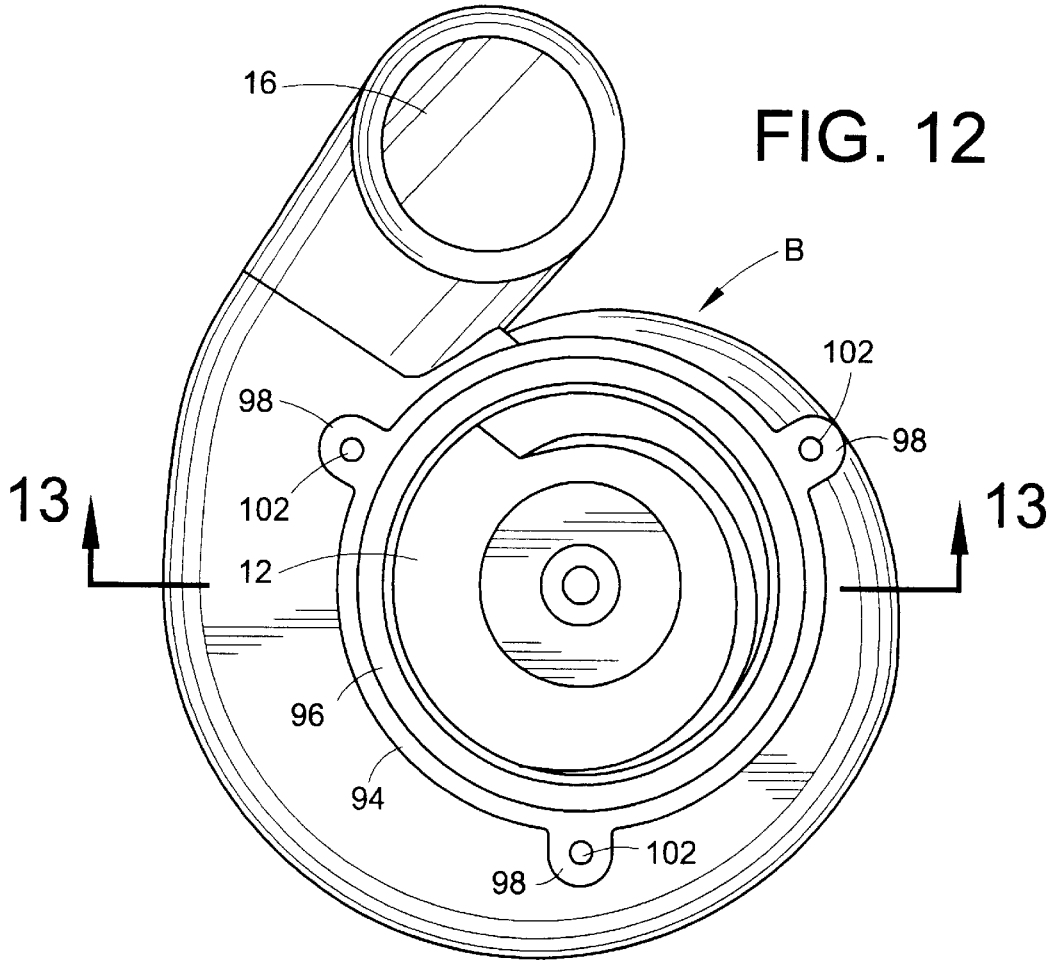
FIG. 12 is a top plan view of a pump base having a volute herein.
Figure 13:
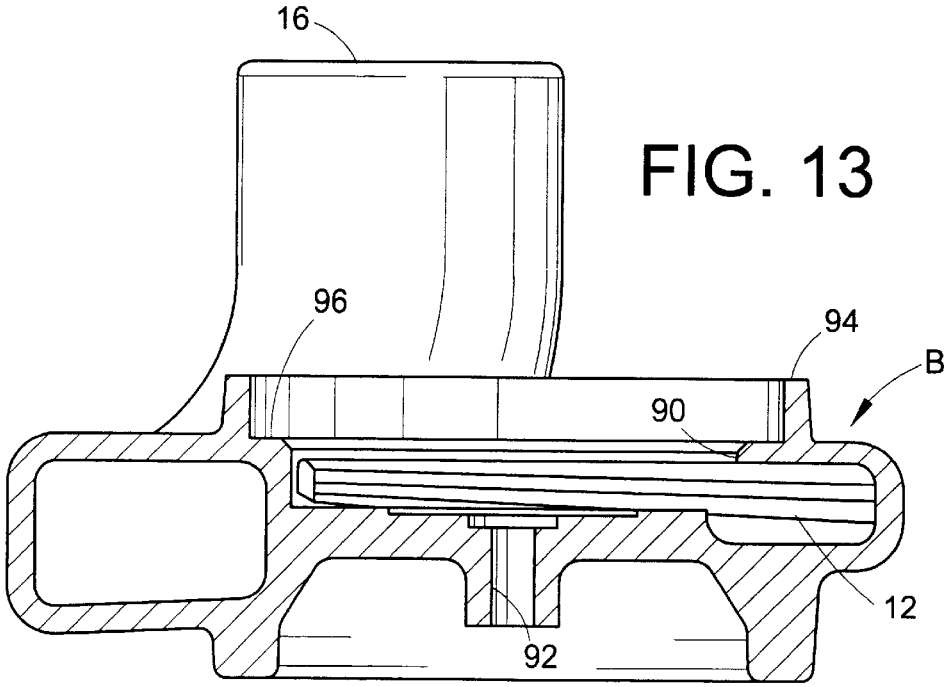
FIG. 13 is a cross-sectional elevational view taken generally on line 13—13 of FIG. 12.

FIGS. 12 and 13 show base B as having a circular top opening 90 to diffuse 10 for receiving the lower end portion of impeller C. Shaft receiving hole 92 for receiving the bottom end portion of shaft 14 of FIGS. 1 and 2 is concentric with circular impeller receiving hole 90. A circular flange 94 extends upwardly from base B in outwardly-spaced relationship to circular hole 90 to provide an annular horizontal shoulder 96 around hole 90. Three equidistantly spaced ears 98 extend outwardly from circular flange 94 and have tapped holes 102 therein for receiving bolts.

Figure 15:
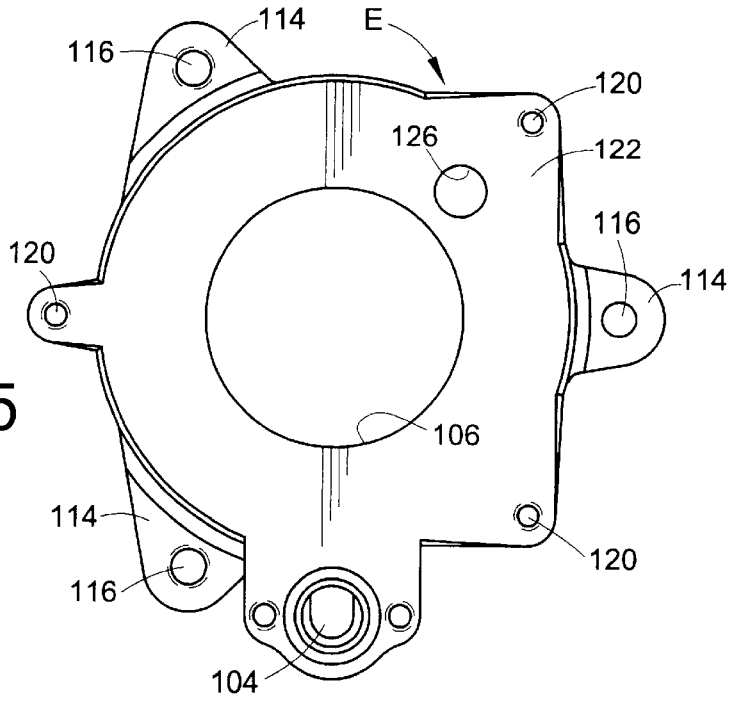
FIG. 15 is a top plan view thereof.
Figure 14:
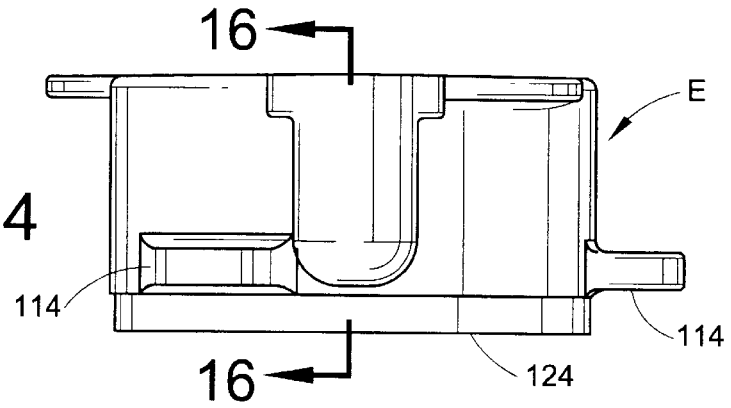
FIG. 14 is a side elevational view of a motor cover.
Figure 16:
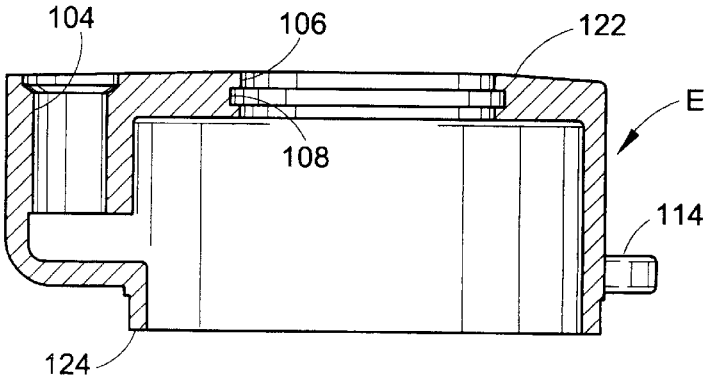
FIG. 16 is a cross-sectional elevational view taken generally on line 16—16 of FIG. 14.
Figure 17:
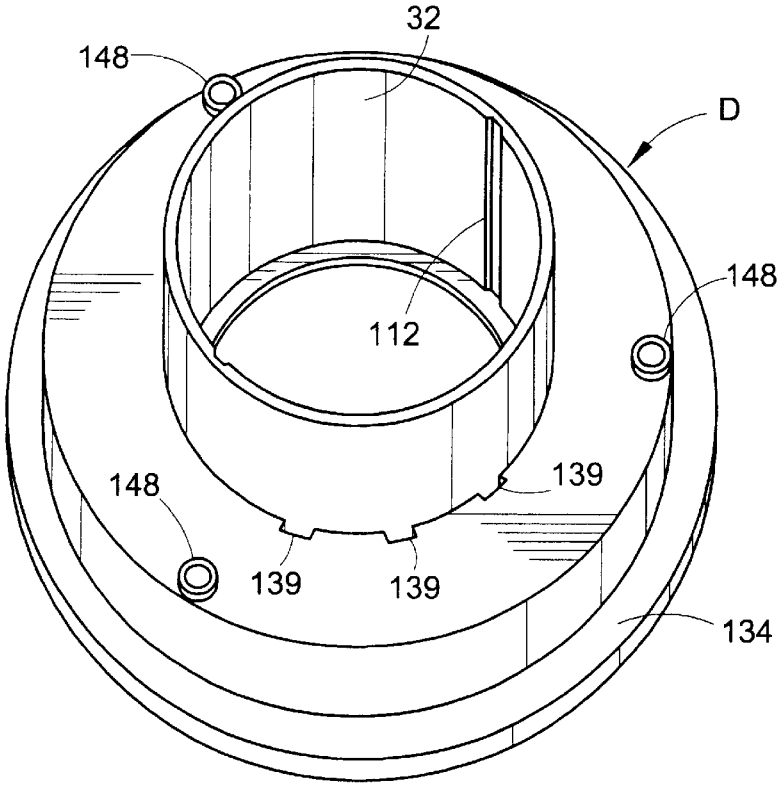
FIG. 17 is a perspective illustration of a permanent magnet motor stator.
Figure 18:
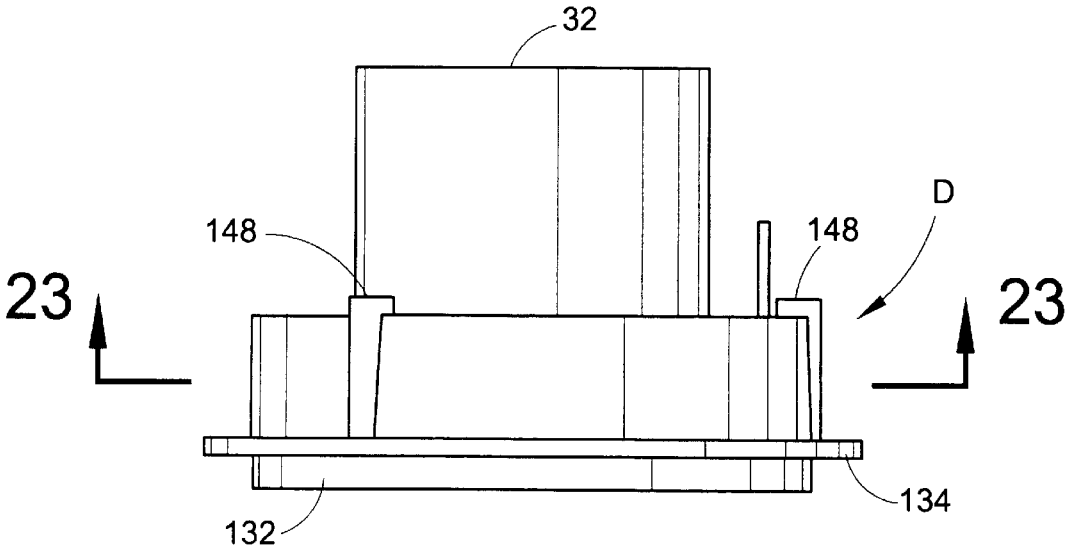
FIG. 18 is a side elevational view thereof.

FIGS. 14–16 show motor cover E having a passage 104 for receiving a power cord that supplies power to motor stator D. Motor cover E has a circular opening 106 for receiving integral sleeve 32 on the stator housing as shown in FIGS. 1 and 2. The peripheral wall of opening 106 has a circumferential groove 108 therein for receiving a sealing ring 110 that engages the outer peripheral surface of sleeve 32 as shown in FIGS. 1 and 2.

Figure 24:
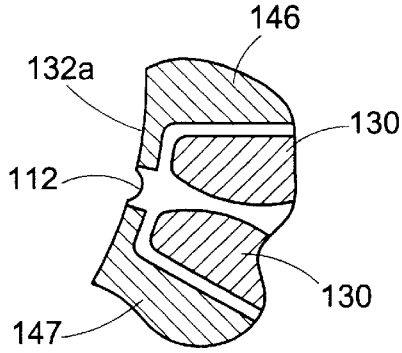
FIG. 24 is an enlarged detail of the circled area in FIG. 23.

The inner peripheral surface of stator housing sleeve 32 has a pair of opposite shallow vertical grooves 111, 112 therein. The outer periphery of the magnet motor ring 20 is in very close proximity to the inner peripheral surface of sleeve 32 to provide a very small clearance space, such as 0.001 inch, and the grooves 111, 112 allow flushing of any small particles that may enter the clearance space. As shown in FIG. 24, each groove 111, 112 is located between a pair of adjacent stator poles 146 so that the thickness of the plastic material 132*a* overlying the pole faces is not reduced.

Motor cover E has three circumferentially-spaced ears 114 extending outwardly therefrom with bolt-receiving holes 116 therethrough. Motor cover E also has three circumferentially-spaced tapped holes 120 therein for receiving the lower threaded end portions of the elongated bolts 40 of FIG. 1 that secure filter assembly F to motor cover E. Thus, the filter assembly rests against the upper surface 122 of motor cover E around opening 106 and inwardly of power cord opening 104. The bottom circular end 124 of motor cover E is adapted to bear against an outwardly extending flange on the plastic material housing of stator assembly D in FIGS. 1 and 2.

A tapped hole 126 in upper surface 122 of motor cover E receives a threaded bottom end on float assembly H for attaching the float assembly to the motor cover within the filter assembly.

FIGS. 17–24 show stator D as having a plurality of circumferentially-spaced stator coils 130 encapsulated in plastic material 132. An outwardly extending flange 134 is provided for clamping stator assembly D between base B and motor cover E as shown in FIGS. 1 and 2. Bolts 140 extend through the holes in ears 114 on motor cover E and thread into the tapped holes in ears 98 on base B to clamp stator flange 134 against base shoulder 96 with a suitable gasket 144 interposed between flange 134 and the bottom end 124 of motor cover E.

Figure 23:
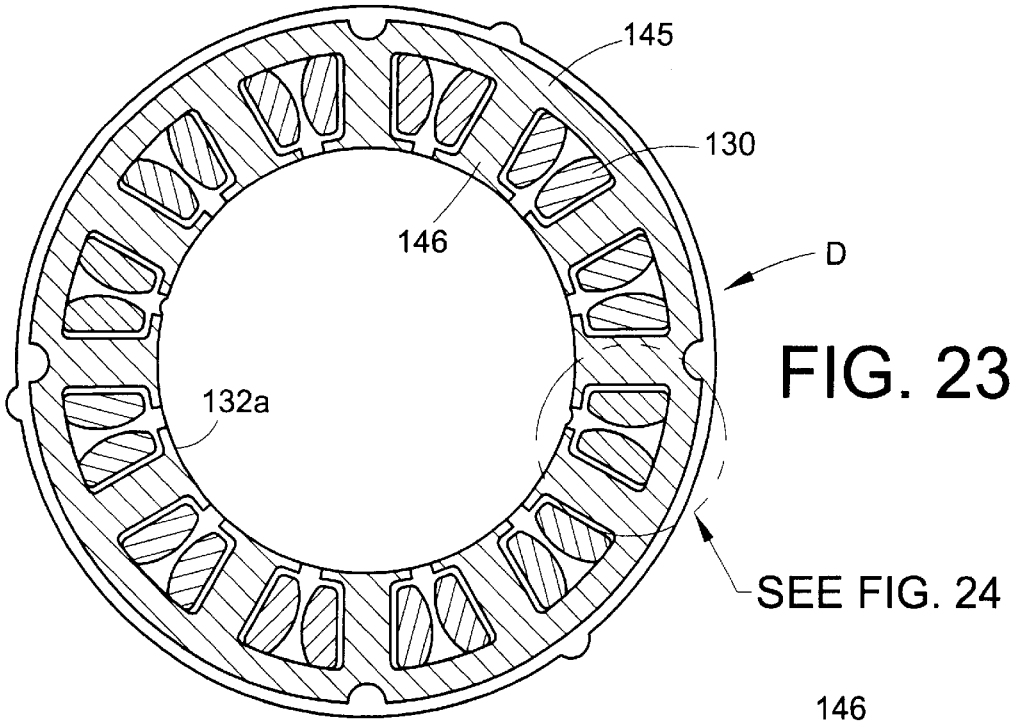
FIG. 23 is a cross-sectional plan view taken generally on line 23—23 of FIG. 18.

FIG. 23 shows motor stator laminations 145 having a plurality of circumferentially-spaced poles 146 with slots therebetween for receiving coils 130 in a known manner. The plastic material that overlies the inner peripheral surfaces of the poles is very thin as generally indicated at 132*a* in FIGS. 20–23. By way of example, plastic material 132*a* may have a minimum thickness of 0.018 inch. The plastic material 132*b* that overlies the coils 130 and extends outwardly from sleeve 32 likewise may be very thin, As shown in FIGS. 19 and 22, three circumferentially-spaced posts 148 having screw receiving inserts 149 therein are molded integrally with the plastic material that forms the stator housing. The top ends of the posts extend above the stator coils as shown in FIG. 22 for supporting an annular printed circuit motor control board spaced above the stator coils.

Figure 25:
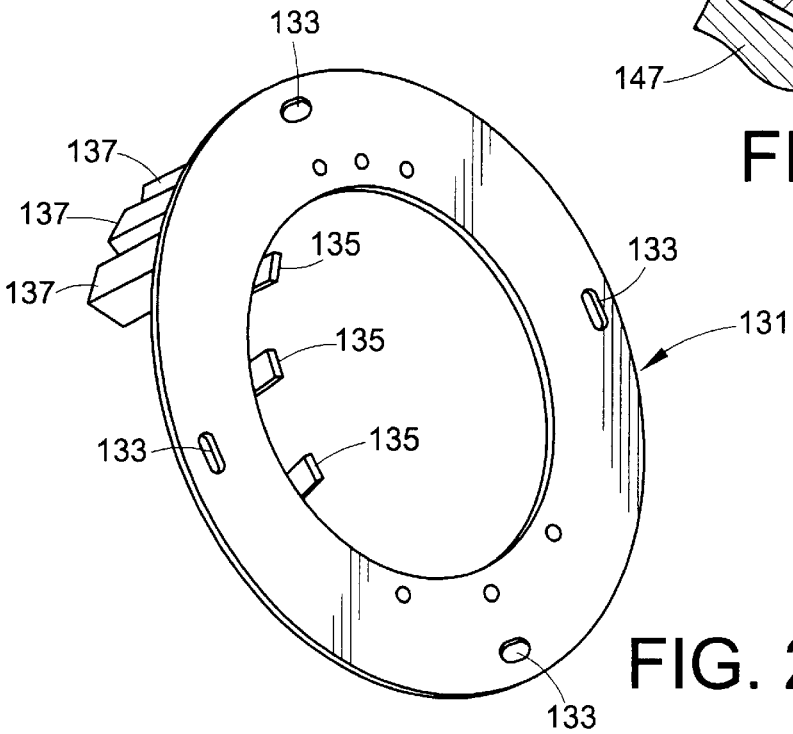
FIG. 25 is a perspective illustration of an annular printed circuit board motor controller that is attached to the stator assembly of FIGS. 17–24.
Figure 26:
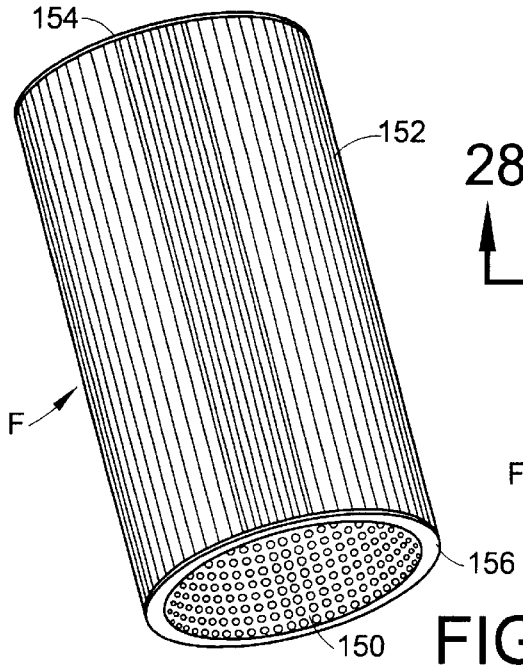
FIG. 26 is a perspective illustration of an inlet filter assembly.
Figure 27:
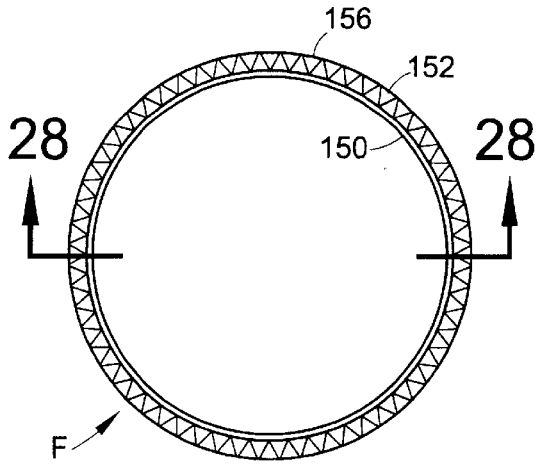
FIG. 27 is a top plan view thereof with the upper assembly ring removed for clarity of illustration.
Figure 28:
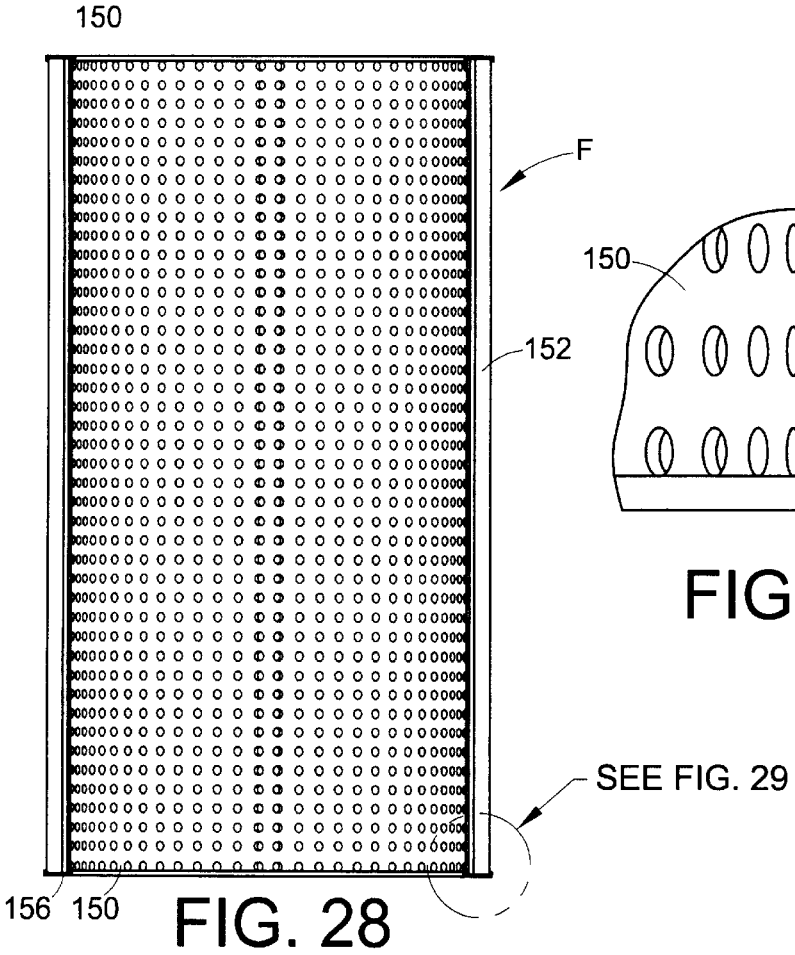
FIG. 28 is a cross-sectional elevational view thereof taken generally on line 28—28 of FIG. 27.

FIG. 25 shows a generally flat annular printed circuit board 131 having a plurality of circumferentially-spaced screw receiving slots 133 therein for receiving screws to secure board 131 to posts 148 on stator assembly D. Three spaced-apart Hall effect sensors 135 are attached to the inner periphery of board 131 so that they are located in very close proximity to and aligned with the upper end of permanent magnet motor ring 20 on impeller C for use in controlling current flow to the three-phase coil assembly on the stator for operating the motor. Three MOSFETS 137 extend from board 131 and are received in openings 139 of FIGS. 17 and 19 in the plastic material housing for stator D for controlling current to the stator coils. Circuitry on the printed circuit board, along with a microprocessor, responds to input from the float switches, Hall effect sensor, MOSFETS and other input controls to control operation of the brushless permanent magnet motor. The float switches are connected with the circuit board in a known manner.

Three spaced slot openings 141 in plastic material 132*b* are provided to connect the three motor leads for the three phase stator coils with the circuitry on printed circuit board 131. The printed circuit board 131 is secured to stator post 148 by screws 143 as best shown in FIG. 2.

Figure 29:
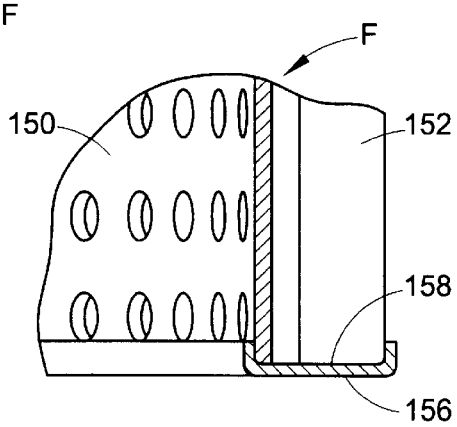
FIG. 29 is an enlarged cross-sectional detail taken on detail 29 of FIG. 28.

FIGS. 26–29 show filter assembly F having a cylindrical perforate stainless steel sheet metal member 150 and an outer cylindrical eight mesh stainless steel screen 152 that is pleated or corrugated. Upper and lower rings 154, 156 have open channels 158 as indicated in FIG. 29 for receiving the top and bottom ends of the pleated screen and the sheet metal member. Sheet metal member 150 and eight mesh screen 152 may be secured within the ring channels by epoxy, welding or in any other suitable manner.

Cylindrical filter member 150 of 22 gauge stainless steel has a metal thickness of approximately 0.03 inch. Staggered holes of 0.25 inch diameter are provided throughout filter member 150 on staggered 0.312 inch centers. The pleats in eight mesh stainless steel screen 152 have a radial dimension of approximately 0.169 inch. That is, the distance from the outer surface of filter member 150 to the outer diameter of the pleated screen is approximately 0.169 inch. Obviously, other perforation sizes, mesh sizes and pleat sizes may be used.

FIG. 30 is a very diagrammatic illustration that provides an example of how the float switches may operate the brushless DC permanent magnet pump motor. Normally open upper and lower float switches 160, 162 are connected through a relay R with motor M. As water rises in the sump in which the pump is received, lower float switch 162 will close. As the water continues to rise, upper float switch 160 will close to energize motor M. Closing of upper float switch 160 also energizes relay R that closes normally open relay contact RC1. The motor then runs to discharge water from the sump. As the water falls below the upper float, upper float switch 160 will open but motor M will remain energized through relay contact RC1, lower float switch 162 and relay R. When the liquid level falls below the bottom float, lower float switch 162 will open to deenergize motor M. In a commercial embodiment, operation of the float switches is incorporated into the pump electronics and software to operate the pump motor.

FIG. 31 is a diagrammatic showing of a typical float operated reed switch wherein a reed switch 160 having a glass or other non-magnetic housing contains normally open reed contacts 162, 164. An annular permanent magnet 166 carried by float 54 closes reed contacts 162, 164 when float 54 moves upwardly. Subsequent downward movement of the float opens the switch. The upper float switch may operate in a similar manner.

In the arrangement of the present application, placement of the permanent magnet motor rotor on the inlet side of the impeller allows the outer periphery of the magnet to serve as a leakage control device. Providing a very small radial clearance between the magnet rotor outer periphery and the inner surface of stator sleeve 32 significantly minimizes leakage of high pressure liquid back into the pump inlet and this enhances pump efficiency. Inlet liquid also flows axially through the center of the magnet rotor to the impeller vanes.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A sump pump having a base containing a motor and impeller, a filter attached to said base and extending upwardly therefrom above said motor and impeller, and a float switch assembly extending upwardly from said base inside of said filter for operating said motor.

2. The pump of claim 1 wherein said float switch assembly includes an elongated stalk attached to said base and extending upwardly therefrom, and at least one float switch supported on said stalk.

3. The pump of claim 2 including a pair of upper and lower float switches supported on said stalk.

4. The pump of claim 2 wherein said stalk includes a spacer extending outwardly therefrom in engagement with said filter.

5. The pump of claim 4 wherein said stalk has a top end and said spacer extends outwardly from said top end.

6. The pump of claim 2 wherein said filter comprises a cylindrical perforate filter.

7. The pump of claim 6 wherein said cylindrical perforate filter includes a perforate cylindrical sheet metal member.

8. The pump of claim 7 wherein said filter includes a pleated mesh screen surrounding said sheet metal member.

9. The pump of claim 8 including upper and lower rings having ring channels receiving upper and lower cylindrical ends of said mesh screen and said sheet metal member.

10. The pump of claim 2 wherein said filter includes a cylindrical screen having vertical pleats therein.

11. A pump impeler having a hollow central hub for receiving a shaft, said hub having a hub bottom end portion, a plurality of circumferentially-spaced vanes extending in a direction outwardly of said hub bottom end portion, an annular shroud extending upwardly from said vanes in outwardly-spaced surrounding relationship to said hub to provide an annular liquid inlet passage between said hub and annular shroud leading to said vanes, and a permanent magnet motor rotor attached to said annular shroud on the opposite side thereof from said inlet passage above said vanes.

12. The impeller of claim 11 including a steel ring attached to said annular shroud beneath said permanent magnet rotor.

13. The impeller of claim 12 wherein said annular shroud has upper and lower annular flanges extending outwardly therefrom and defining an annular channel therebetween, said steel ring being received in said channel.

14. A pump impeller having a hollow central hub for receiving a shaft, said hub having a hub bottom end portion, a plurality of circumferentially-spaced vanes extending in a direction outwardly of said hub bottom end portion, an annular shroud extending upwardly from said vanes in outwardly-spaced surrounding relationship to said hub to provide an annular liquid inlet passage between said hub and annular shroud leading to said vanes, a permanent magnet rotor carried by said shroud, a motor stator surrounding said rotor, said stator being encapsulated in plastic material that defines a stator housing, said stator housing including a cylindrical sleeve extending upwardly from said impeller, said sleeve having a sleeve inner surface and said rotor having a rotor outer surface closely adjacent said sleeve inner surface, and said sleeve providing a liquid flow passage through which liquid is guided to said impeller inlet passage.

15. A sump pump including a volute having a volute outlet, an impeller rotatably mounted in said volute for discharging liquid through said volute outlet, said impeller including a central hub having a hub bottom shroud extending outwardly therefrom, a plurality of circumferentially-spaced vanes extending outwardly of said hub above said hub bottom shroud to provide a plurality of outwardly facing impeller outlets therebetween in said volute, said impeller having an integral annular shroud surrounding said hub in outwardly spaced relationship thereto above said vanes to provide an annular liquid inlet passage to said vanes between said hub and annular shroud, a permanent magnet rotor carried by said annular shroud, and a motor stator surrounding said magnet rotor.

16. The pump of claim 5 wherein said motor stator is encapsulated in plastic material that defines a stator housing, said rotor having a rotor outer surface, said stator housing including a sleeve extending upwardly from said impeller annular shroud, said shroud having a shroud inner surface in close proximity to said rotor outer surface, and said sleeve providing a liquid flow passage for directing liquid toward said impeller inlet passage.

* * * * *

UNITED STATES PATENT AND TRADEMARK OFFICE

CERTIFICATE OF CORRECTION

PATENT NO. : 6,443,715 B1 
DATED : September 3, 2002
INVENTOR(S) : Philip A. Mayleben, Scott R. Graham and Buford A. Cooper It is certified that error appears in the above-identified patent and that said Letters Patent is hereby corrected as shown below:

Column 8,
Line 44, change "5" to -- 15 --

Signed and Sealed this

Twenty-fourth Day of December, 2002

JAMES E. ROGAN
*Director of the United States Patent and Trademark Office*